US010508791B2

(12) United States Patent
Drumm

(10) Patent No.: US 10,508,791 B2
(45) Date of Patent: Dec. 17, 2019

(54) CONVERSION OF PRIMARY LIGHT INTO SECONDARY LIGHT BY MEANS OF A WAVELENGTH CONVERTER

(71) Applicant: OSRAM GmbH, Munich (DE)

(72) Inventor: Jan Oliver Drumm, Regensburg (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 16/195,947

(22) Filed: Nov. 20, 2018

(65) Prior Publication Data

US 2019/0154237 A1 May 23, 2019

(30) Foreign Application Priority Data

Nov. 23, 2017 (DE) ..... 10 2017 220 918

(51) Int. Cl.

| | |
|---|---|
| ***F21V 9/32*** | (2018.01) |
| ***F21S 41/176*** | (2018.01) |
| ***F21S 41/16*** | (2018.01) |
| ***F21V 9/30*** | (2018.01) |
| ***F21V 13/08*** | (2006.01) |
| ***F21W 131/406*** | (2006.01) |

(52) U.S. Cl.

CPC ..... *F21V 9/32* (2018.02); *F21S 41/16* (2018.01); *F21S 41/176* (2018.01); *F21V 9/30* (2018.02); *F21V 13/08* (2013.01); *F21W 2131/406* (2013.01)

(58) Field of Classification Search

CPC ..... F21S 41/16; F21S 41/176; F21V 13/08; F21V 9/32; F21V 9/30; F21W 2131/406; F21Y 2115/30; F21K 9/64

See application file for complete search history.

(56) References Cited

U.S. PATENT DOCUMENTS

| | | | | |
|---|---|---|---|---|
| 10,365,551 | B2 * | 7/2019 | Nagasaki | G03B 21/204 |
| 2016/0290856 | A1 | 10/2016 | Fiederling et al. | |
| 2016/0369954 | A1 * | 12/2016 | Anc | H01L 33/502 |
| 2019/0097095 | A1 * | 3/2019 | Yamanaka | G02B 5/0205 |
| 2019/0219248 | A1 * | 7/2019 | Patent | F21S 41/176 |

OTHER PUBLICATIONS

German Search Report based on application No. 10 2017 220 918.6 (7 pages) dated Apr. 11, 2018 (for reference purpose only).

* cited by examiner

*Primary Examiner* — Peggy A Neils

(57) ABSTRACT

A wavelength converter includes a converter layer for at least partly converting primary light of a first spectral composition into secondary light of a second spectral composition, an electrically insulating first insulation layer arranged below the converter layer, a mirror being arranged at the front side of said insulation layer facing the converter layer, at least one conductor track which is arranged at the first insulation layer and which extends laterally at a distance from the mirror, mutually spaced apart contacts extending through the first insulation layer, of which contacts in each case at least two contacts electrically connect a conductor track to a rear side of the first insulation layer, and mutually spaced apart electrically conductive solder connection volumes arranged below the first insulation layer, said solder connection volumes being electrically connected in each case to one of the contacts.

15 Claims, 2 Drawing Sheets

CONVERSION OF PRIMARY LIGHT INTO SECONDARY LIGHT BY MEANS OF A WAVELENGTH CONVERTER

CROSS-REFERENCE TO RELATED APPLICATION

This application claims priority to German Patent Application Serial No. 10 2017 220 918.6, which was filed Nov. 23, 2017, and is incorporated herein by reference in its entirety.

TECHNICAL FIELD

Various embodiments relate generally to a wavelength converter including a converter layer for converting primary light of a first spectral composition into secondary light of a second spectral composition. Various embodiments also relate generally to a converter assembly including at least one such wavelength converter, wherein the at least one wavelength converter is secured to at least one carrier substrate of the converter assembly and is electrically connected to the carrier substrate. Various embodiments furthermore relate generally to a lighting device including at least one such converter assembly and at least one primary light source for irradiating the converter layer with the primary light. Various embodiments additionally relate generally to a headlight/spotlight including at least one such lighting device. Various embodiments are applicable e.g. to headlights/spotlights, e.g. to vehicle headlights, spotlights for stage lighting or spotlights for effect lighting.

BACKGROUND

A conventional LARP ("Laser Activated Remote Phosphor") light source has a converter layer for converting primary light of a first spectral composition into secondary light of a second spectral composition is irradiated with primary light in the form of laser light. The converter layer then emits only secondary light or a mixture of the converted secondary light and non-converted primary light. LARP light sources have the advantage that in conjunction with a compact construction they can generate high luminous fluxes with at the same time high luminance. In this case, so-called reflective arrangements are usually used for generating particularly high luminous fluxes and luminances, in which arrangements the emitted light, e.g. the mixed light, is emitted from the same side of the converter layer at which the primary light is also incident. In order to obtain a high conversion efficiency and to prevent light from emerging at the rear side of the converter facing away from the irradiated side, a mirror is typically fitted at the rear side. The mirror reflects light emerging from the rear side of the converter back into the converter.

However, in the case of such LARP light sources, high thermal loadings, e.g. cyclic alternating loads, can occur at the converter and can lead to damage or even to failure (e.g. detachment) of the converter. In that case an amount of primary light harmful to human beings may possibly be coupled into a useful light path without being noticed, e.g. primary light reflected at detached particles or even directly from the mirror. It is particularly disadvantageous here if, in the event of a mechanical fracture, reflectively coated fragments of the mirror pass into the beam path.

In order to monitor a mechanical integrity of the converter with reflective arrangement, hitherto it has been known to monitor a ratio of the proportions of primary light and secondary light in the mixed light in the useful light path. This exploits the fact that the ratio may change as a result of damage to the converter layer. However, disadvantageously, such monitoring is not particularly reliable.

Moreover, it is known to use beam traps that block primary light which has not penetrated into the converter but has been reflected at particles. What is disadvantageous here is that space has to be additionally provided for this and, what is more, primary light that is reflected in this way and follows the useful light path is not blocked.

SUMMARY

A wavelength converter includes a converter layer for at least partly converting primary light of a first spectral composition into secondary light of a second spectral composition, an electrically insulating first insulation layer arranged below the converter layer, a mirror being arranged at the front side of said insulation layer facing the converter layer, at least one conductor track which is arranged at the first insulation layer and which extends laterally at a distance from the mirror, mutually spaced apart contacts extending through the first insulation layer, of which contacts in each case at least two contacts electrically connect a conductor track to a rear side of the first insulation layer, and mutually spaced apart electrically conductive solder connection volumes arranged below the first insulation layer, said solder connection volumes being electrically connected in each case to one of the contacts.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
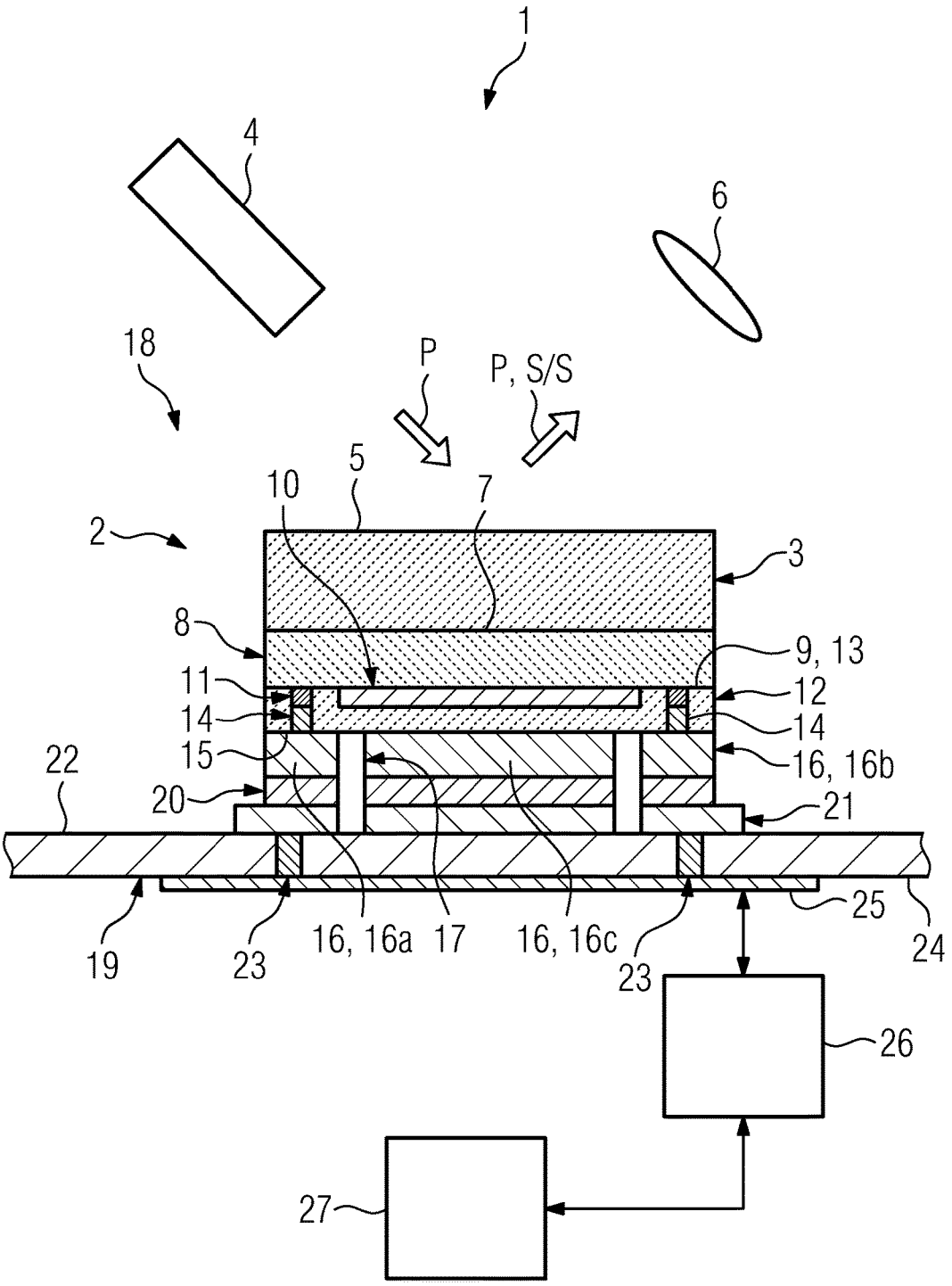
FIG. 1 shows, as a sectional illustration in side view, a headlight/spotlight including a wavelength converter in accordance with a first embodiment.

The following detailed description refers to the accompanying drawings that show, by way of illustration, specific details and embodiments in which the invention may be practiced.

Various embodiments at least partly overcome the disadvantages of the prior art.

Various embodiments provide a wavelength converter, including

- a converter layer for converting primary light of a first spectral composition into secondary light of a second spectral composition,
- a first electrically insulating insulation layer arranged below the converter layer, a mirror being arranged at the front side of said insulation layer facing the converter layer, at least one conductor track which is arranged at the first insulation layer and which extends laterally at a distance from the mirror, mutually spaced apart contacts extending through the first insulation layer, of which contacts in each case at least two contacts electrically connect a conductor track to a rear side of the first insulation layer, mutually spaced apart electrically conductive material volumes (referred to as "solder connection volumes" hereinafter without restricting the generality) arranged below the first insulation layer, said solder connection volumes being electrically connected in each case to one of the contacts.

Such a wavelength converter has the advantage that in a compact manner and practically without limiting a freedom of design for assemblies based thereon, the possibility is afforded of detecting damage, e.g. depth cracks, of the converter layer e.g. also already before a detachment of the converter layer. The effect is also afforded that such a wavelength converter is particularly robust and resistant, e.g. vis-à-vis ingress of moisture to the mirror (protection against corrosion).

This wavelength converter makes use of the fact that damage to the converter layer generally takes place as a result of crack propagation and these cracks typically propagate into the depth of the converter layer and/or form at the edge of the converter and run laterally into the converter. In this case, the crack propagation is even continued into the first insulation layer, as a result of which the at least one electrically conductive conductor track is damaged. Damage to a conductor track in turn can be identified by a change in its electrical property, e.g. by an increased resistance in the event of its being interrupted. The electrical properties of the at least one conductor track can be detected since the at least one conductor track is electrically contactable by way of the contacts extending through the first insulation layer and the associated solder connection volumes. Consequently, the at least one conductor track can be electrically connected to a detector circuit.

The converter layer (also able to be referred to as phosphor body) includes at least one phosphor suitable for converting incident primary light at least partly into secondary light having a different wavelength. If a plurality of phosphors are present, they can generate secondary light having mutually different wavelengths. The wavelength of the secondary light can be longer (so-called "Down Conversion") or shorter (so-called "Up Conversion") than the wavelength of the primary light. By way of example, blue primary light can be converted into green, yellow, orange or red secondary light by means of a phosphor. In the case of only partial wavelength conversion, the converter layer emits a mixture of secondary light and non-converted primary light, which mixture can serve as useful light. By way of example, white useful light can be generated from a mixture of blue, non-converted primary light and yellow secondary light. However, full conversion is also possible, wherein the primary light is either no longer present or present in only a negligible proportion in the useful light. A degree of conversion depends for example on a thickness and/or a phosphor concentration of the phosphor. If a plurality of phosphors are present, secondary light portions of different spectral compositions can be generated from the primary light, e.g. yellow and red secondary light. The red secondary light can be used for example to give the useful light a warmer hue, e.g. so-called "warm-white". If a plurality of phosphors are present, at least one phosphor may be suitable for subjecting secondary light once again to wavelength conversion, e.g. green secondary light into red secondary light. Such a light produced by wavelength conversion once again from a secondary light may also be referred to as "tertiary light".

The converter layer may include phosphor particles, e.g. powder particles, embedded in a distributed fashion in a light-transmissive matrix material. The matrix material may include e.g. silicone, epoxy resin or glass. The converter layer may also include or essentially consist of a wavelength-converting body, for example of wavelength-converting ceramic such as YAG:Ce, LuAG, $LiEuMo_2O_8$ or $Li_3Ba_2Eu_3(MoO_4)_8$. The phosphor body can be a laminar phosphor body.

In one development, the converter layer is an integral converter layer. The latter can be produced particularly simply.

In one development, the converter layer is a converter layer composed of a plurality of segments, or segmented converter layer. This affords the advantage that a particularly large converter layer can be produced.

In one development, the converter layer is a laminar converter layer. A thickness of the converter layer can be e.g. up to 5000 micrometers, but can also be even thicker.

In one development, a lateral extent of the converter layer is approximately 1 millimeter to 2 millimeters. However, it can also be smaller or even larger.

The converter layer can constitute e.g. a topmost layer of the wavelength converter. It can additionally be covered, if appropriate, with a protective layer that is transmissive, e.g. transparent, to the primary light and the secondary light.

The first insulation layer is an electrically insulating layer. By way of example, the first insulation layer electrically insulates the contacts extending through it from one another. The first insulation layer can be fixedly connected to the converter layer (if appropriate by way of one or more intermediate layers) e.g. outside the mirror and, if appropriate, the at least one conductor track.

Light emerging at a rear side of the converter layer facing the mirror impinges on the mirror and is reflected back into the converter layer by means of the mirror.

In one development, the mirror is a reflective layer or coating. The mirror can then also be referred to as "reflector layer".

The fact that a conductor track extends laterally at a distance from the mirror can encompass e.g. the fact that the conductor track extends laterally outside the mirror in a plan view of the converter layer and/or the first insulation layer, that is to say is at a distance from the mirror in a lateral direction with respect to the mirror or a plane of the mirror. A conductor track may include or essentially consist e.g. of metal, e.g. of copper, silver, etc.

The electrically conductive contacts extending through the first insulation layer can be configured e.g. as through contacts. A conductor track can be electrically connected to two or more through contacts, e.g. to exactly two through contacts. The contacts can directly contact e.g. the associated conductor track. The contacts lead e.g. to a rear side of the first insulation layer facing away from the mirror. The contacts may include or essentially consist e.g. of metal, e.g. of copper, silver, etc. Generally, the material of the contacts can correspond to the material of the conductor track connected thereto, which can be advantageous in terms of production engineering, or can deviate from the material of the conductor track connected thereto.

A "solder connection volume" can generally be understood to mean a volume composed of an electrically conductive material. In one development, a solder connection volume is suitable for use with a soldering connection method, that is to say e.g. is wettable by solder, is resistant to customary soldering temperatures, etc. In one development, a solder connection volume is a body that is dimensionally stable vis-à-vis soldering, e.g. does not itself consist of solder material. A solder connection volume can also be referred to as "contact foot", "contact leg", "securing contact" or the like.

The solder connection volumes can be directly connected to exactly one associated through contact, e.g. directly contact the latter.

In one configuration, the at least one conductor track is embedded or buried in the first insulation layer. This achieves a particularly compact arrangement in which the first insulation layer is connectable over a large area, and e.g. in a plane fashion, to a layer arranged thereabove or on the front side.

In one development, the at least one conductor track is exposed at the front side of the first insulation layer facing the converter layer. This affords the effect that the at least one conductor track can be directly fixedly connected to a layer arranged at the front side—e.g. the converter layer or, if appropriate, an intermediate layer. This in turn facilitates transfer of crack propagation from the converter layer into the conductor track and thus enables cracks in the converter layer to be detected particularly reliably.

Alternatively or additionally, the at least one conductor track can be completely buried in the first insulation layer, that is to say also be covered by the first insulation layer on the front or top side.

In one development, the converter layer bears directly on the first insulation layer, e.g. is directly connected to the first insulation layer. This likewise facilitates transfer of crack propagation from the converter layer into the at least one conductor track embedded in the first insulation layer and thus enables cracks in the converter layer to be detected particularly reliably.

In one configuration, a second electrically insulating insulation layer, which second insulation layer is optically transmissive to the primary light and the secondary light, is present between the converter layer and the first insulation layer. As a result, the mirror may be introduced into the wavelength converter more simply. This may be the case, for example, if the mirror is intended to be implemented as a thin metallic layer, but a direct metallization of the converter layer is implementable only with difficulty in terms of production engineering. Moreover, the second insulation layer can reduce absorption of light at the first insulation layer.

In one development, a hardness of the second insulation layer is at least of the same magnitude as a hardness of the first insulation layer, which may facilitate crack propagation toward the at least one conductor track.

In one development, the second insulation layer is resistant vis-à-vis soldering of the solder connection volumes, e.g. vis-à-vis the temperatures introduced into the latter during soldering.

In one development, the second insulation layer consists of zirconium(IV) oxide ($ZrO_2$), silicon oxide ($SiO_2$), tantalum(V) oxide ($Ta_2O_5$), niobium(III) oxide ($Nb_2O_3$), aluminum oxide ($Al_2O_3$) etc., e.g. of an oxide ceramic. Such materials are electrically insulating, optically transparent, hard and resistant to high temperatures.

The first insulation layer need not be optically transmissive to the primary light and the secondary light, but it may be advantageous in terms of production engineering if the material of the first insulation layer corresponds to the material of the second insulation layer. Generally, the first insulation layer may include or essentially consist of ceramic, which likewise makes it resistant to high temperatures and thus e.g. resistant vis-à-vis a soldering process.

In one configuration, at least one conductor track is a conductor track which surrounds the mirror in a ring-shaped fashion. This affords the effect that cracks that occur are detectable from all sides around the mirror. The ring shape can be a circlelike, oval, angular (e.g. rectangular, e.g. square) etc. ring shape.

In one configuration, the at least one conductor track is exactly one conductor track. Such a conductor track can be evaluated with a particularly low outlay.

In one configuration, the at least one conductor track, e.g. the exactly one conductor track, surrounds the mirror in a ring-shaped fashion in a plurality of loops. This affords the effect that a particularly large area is able to be utilized for detecting cracks in conjunction with the use of only a small number of conductor tracks. The loops can extend e.g. in a meandering fashion.

In one configuration, the at least one conductor track includes a plurality of conductor tracks spaced apart from one another and each surrounding the mirror in a ring-shaped fashion. This, too, affords the effect that a particularly large area is able to be utilized for detecting cracks. Owing to the use of a plurality of conductor tracks, a particularly precise localization of cracks that have occurred is possible depending on a distance with respect to the mirror.

In one development, the plurality of conductor tracks surround the mirror concentrically.

In one configuration, the at least one conductor track includes a plurality of conductor tracks which surround the mirror as mutually spaced apart segments in a ring-shaped or practically ring-shaped fashion. The segments enable a particularly precise localization of cracks that have occurred depending on an angular position in a circumferential direction with respect to the mirror.

In one configuration, an electrically conductive layer is arranged at the rear side of the first insulation layer, said layer (referred to as "transition layer" hereinafter without restricting the generality) including a plurality of partial regions separated from one another, and the solder connection volumes correspond to partial regions. This affords the effect that the solder connection volumes can be produced particularly simply, e.g. in the context of a layer production process.

In one development, each solder connection volume corresponds to one of the partial regions. However, not all partial regions need correspond to solder connection volumes, but can do this.

In one development, the separated partial regions are separated by subsequently introduced trenches (e.g. notches, cuts, etc.) extending from an underside as far as a top side (and thus as far as the first insulation layer). This is implementable particularly simply in terms of production engineering.

In one configuration, at least one heat transfer volume is arranged at the rear side of the first insulation layer. The heat transfer volume consists of a material having good thermal conductivity and advantageously enables an intensified heat dissipation from the converter layer by way of the first insulation layer to a substrate to which the wavelength converter is fitted by its solder connection volumes. The dissipated heat corresponds e.g. to waste heat generated in the converter layer, e.g. Stokes' heat, which arises on account of an energy loss of the photon during wavelength conversion, said energy loss being converted into thermal or vibrational energy in the converter layer.

In one configuration, the at least one heat transfer volume corresponds to a partial region of the transition layer. In this regard, the at least one heat transfer volume can be provided particularly simply in terms of production engineering.

In one configuration, the solder connection volumes consist of electrically conductive ceramic. This affords the advantage that the solder connection volumes are resistant to high temperatures, e.g. also withstand typical temperatures that occur during a soldering process, and moreover are particularly stable.

If the solder connection volumes are configured as partial regions of a transition layer, said transition layer also consists of electrically conductive ceramic. If, moreover, the at least one heat transfer volume is also configured as partial regions of a transition layer, it also consists of electrically conductive ceramic. This affords the effect that a heat transfer volume having very good thermal conductivity is also provided. However, the at least one heat transfer volume can generally also consist of some other material having good thermal conductivity, e.g. of an (identical or other) ceramic material, of metal, etc.

In one configuration, the first insulation layer has a cutout extending from the mirror to the heat transfer volume, said cutout being filled with a heat conductive volume. In this regard, heat dissipation from the converter layer can be intensified even further. The heat conductive volume is electrically insulated from the through contacts by the first insulation layer. The heat conductive volume can be electrically conductive, e.g. may include or essentially consist of metal, or can be electrically insulating. The cutout may have been introduced into the first insulation layer subsequently, e.g. by means of an etching method.

In one configuration, the mirror is a dielectric mirror. For example with the use of a dielectric mirror, the second insulation layer can also be dispensed with, which facilitates production of the wavelength converter. The dielectric mirror can also be referred to as a dichroic mirror or an interference mirror.

In one configuration, the mirror is a metallic mirror.

In one configuration, the at least one conductor track consists of the same material as the mirror. This facilitates production of the wavelength converter. In one development, the at least one conductor track includes or essentially consists of the same metal as the mirror, e.g. of silver, copper, a combination thereof, etc.

In one configuration, the converter layer is a ceramic layer. This affords the effect that a particularly high conversion efficiency is achievable even for thin layers. Moreover, the ceramic layer is highly temperature-stable and resistant vis-à-vis aging phenomena.

In one development, the first insulation layer or—if present—the second insulation layer has been applied on a rear side of the converter layer or on a rear side of the first insulation layer by means of a layer applying method. The use of a layer applying method enables particularly secure fitting and/or particularly precise shaping of the applied layer.

In one development, the mirror has been applied on the converter layer by means of a layer applying method.

In one development, the at least one conductor track has been applied on the converter layer or on the first insulation layer by means of a layer applying method.

If a second insulation layer is present, the first insulation layer may have been applied on a rear side of the second insulation layer by means of a layer applying method.

In one development, the solder connection volumes and, if present, the at least one heat conductive volume have been applied on a rear side of the second insulation layer by means of a layer applying method. If the solder connection volumes and, if appropriate, the at least one heat conductive volume have been worked from a common transition layer, the transition layer may have been applied on a rear side of the second insulation layer by means of a layer applying method.

Examples of appropriate layer applying methods include CVD methods, PVD methods (such as sputtering, etc.), printing, blade coating, etc. For particularly precise shaping it is advantageous if planar fabrication methods known from semiconductor production have been employed for producing the wavelength converter.

By way of example, the wavelength converter, proceeding from the converter layer, may have been completely produced by means of layer applying methods. In this case, in one variant, the converter layer may have been provided as a basis for production.

In one configuration, the wavelength converter is an SMT component. This facilitates its handling and fitting, e.g. on a substrate. Moreover, an SMT component is solderable.

Various embodiments provide an assembly (referred to as "converter assembly" hereinafter without restricting the generality), including at least one wavelength converter as described above, wherein the at least one wavelength converter is secured to at least one carrier substrate of the converter assembly and is electrically connected to the carrier substrate by way of the solder connection volumes. The converter assembly can be configured analogously to the wavelength converter and affords the same effects.

In one configuration, at least one wavelength converter is secured and electrically connected to an associated carrier substrate by way of a soldering layer. This affords the effect of providing a particularly robust and compact securing possibility for the wavelength converter. Furthermore, the soldering layer is exposed to practically no light, such that light reflections emanating therefrom can be avoided. By way of example, bond wires can be dispensed with.

In one configuration, the carrier substrate has a respective through contact at connection points to the solder connection volumes. As a result, a side of the carrier substrate facing away from the wavelength converter can be electrically connected to the wavelength converter in a simple manner.

In one configuration, the at least one wavelength converter is secured to a substrate front side of the carrier substrate and has, (e.g. only) at a substrate rear side of the carrier substrate, a wiring connected to the through contacts. Light reflections emanating from the wiring can thus advantageously be avoided. The wiring can be a conductor track structure or the like.

In one development, the carrier substrate is a ceramic substrate or includes a base body composed of ceramic, e.g. composed of $Al_2O_3$, AlN, etc.

Various embodiments provide a lighting device, including at least one converter assembly as described above and at least one primary light source for irradiating the converter layer with the primary light. The lighting device can be configured analogously to the converter assembly and/or to the wavelength converter and affords the same effects.

In one development, the at least one primary light source is or includes at least one semiconductor light source. This affords the effect of a high longevity and high luminous fluxes in conjunction with high luminances. If a plurality of semiconductor light sources are present, they can emit light of the same color or of different colors. A color can be monochromatic (e.g. red, green, blue, etc.) or multichromatic (e.g. white). Moreover, the light emitted by the at least one light emitting diode can be an infrared light (IR LED) or an ultraviolet light (UV LED). The at least one semiconductor light source can be present in the form of at least one individually packaged semiconductor light source or in the form of at least one "die" or bare chip. A plurality of semiconductor light sources can be mounted on a common substrate ("submount"). The at least one semiconductor light source can be equipped with at least one dedicated and/or common optical unit for beam guiding, e.g. at least one Fresnel lens, collimator, and so on.

In one configuration, the at least one primary light source is or includes at least one laser light source. The laser light source emits pump light as laser light. A laser light source affords the effect of particularly high luminous fluxes in conjunction with particularly high luminances. The at least one primary light source may include at least one diode laser.

In one development, the at least one primary light source is or includes at least one light emitting diode. Instead of or in addition to inorganic light emitting diodes, e.g. on the basis of InGaN or AlInGaP, organic LEDs (OLEDs, e.g. polymer OLEDs) are generally usable as well.

In one configuration, the primary light is blue light and the converter layer is configured to convert the primary light partly into yellow secondary light. In this regard, white mixed light can be generated in a particularly simple and safe manner.

Alternatively, the primary light can be e.g. UV light and the converter layer is configured to convert the primary light completely into red, green and blue secondary light, for example. In this regard, white mixed light having an especially high intensity can be generated.

In one development, the primary light beam is incident on the converter layer obliquely. This enables the useful light emitted by the converter layer to be coupled out particularly simply. The useful light is composed of the secondary light or a mixture of non-converted primary light and secondary light.

In one development, the primary light beam is incident on the converter layer perpendicularly. This enables a particularly compact construction. An optical unit that separates the incident primary light beam from the useful light beam is then present in the light path.

In one development, the lighting device includes a coupling-out optical unit for coupling out the useful light beam.

In one configuration, the lighting device (indeed if appropriate already the converter assembly) includes a detector circuit, which is electrically connected to the solder connection volumes and which is configured to monitor the at least one conductor track for damage.

In one development, the monitoring includes monitoring an ohmic resistance of at least one conductor track. By way of example, if the ohmic resistance rises above a predefined threshold value (e.g. to practically infinity upon interruption of the conductor track), this can be interpreted as damage to the conductor track.

In an alternative or additional development, the monitoring includes monitoring a current conducted through the at least one conductor track. By way of example, if current falls below a predefined threshold value (e.g. to practically zero upon interruption of the conductor track), this can be interpreted as damage to the conductor track.

In an alternative or additional development, the monitoring includes inductively monitoring the at least one conductor track.

In an alternative or additional development, the monitoring includes capacitively monitoring the at least one conductor track.

In one configuration, the lighting device is configured to initiate at least one action in response to damage to at least one conductor track being identified. Such an action may include dimming or switching off the at least one primary light source, issuing a warning indication and/or closing a shutter, etc.

The object is additionally achieved by means of a headlight/spotlight, including at least one lighting device as described above. The headlight/spotlight can be configured analogously to the lighting device, the converter assembly and/or the wavelength converter and affords the same effects.

In one configuration, the headlight/spotlight is a vehicle headlight.

In one configuration, the headlight/spotlight is a spotlight for stage lighting.

In one configuration, the headlight/spotlight is a spotlight for effect lighting.

FIG. 1 shows, as a sectional illustration in side view, a headlight/spotlight 1 including a wavelength converter 2 in accordance with a first embodiment. The headlight/spotlight 1 can be e.g. a vehicle headlight, a spotlight for stage lighting or a spotlight for effect lighting, but is generally not restricted thereto.

The wavelength converter 2 includes, as topmost layer, a converter layer 3 for at least partly converting primary light P of a first spectral composition (e.g. blue primary light P or UV light as the primary light P) into secondary light S of a second spectral composition (e.g. partly into yellow secondary light S or completely into red, green and blue secondary light S). The wavelength converter 2 is configured as a solderable SMT component.

The headlight/spotlight 1 includes a primary light source 4 for illuminating the converter layer 3, which primary light source may include e.g. one or more lasers. The light emitted by the primary light source 4 impinges on a front side 5 of the converter layer 3. The secondary light S or a mixture of non-converted primary light P and the secondary light S as useful light P, S/S is also emitted from the front side 5 of the converter layer 3. The useful light P, S/S can be coupled out from the headlight/spotlight 1 by means of a coupling-out optical unit 6, indicated here in a simplified manner. In the case of perpendicular incidence of the primary light P, the coupling-out optical unit 6 can also have an e.g. dichroic beam splitter.

The converter layer 3 is configured here as a laminar wavelength-converting ceramic layer.

An optional second insulation layer 8 is present over a large area, e.g. over the whole area, at a rear side 7 of the converter layer 3. Said second insulation layer may have been applied by means of a planar fabrication method from semiconductor production, e.g. by sputtering. The second insulation layer 8 is electrically insulating and transmissive, e.g. transparent, to the primary light P and the secondary light S. The second insulation layer 8 may be a ceramic layer, for example.

A mirror in the form of a reflector layer 10 that reflects the primary light P and the secondary light S is arranged centrally at a rear side 9 of the second insulation layer 8. The reflector layer 10 thus bears on the rear side of the second insulation layer 8 and is e.g. fixedly connected thereto. The reflector layer 10 has a lateral extent that is smaller than a lateral extent of the rear side 9, such that a circumferential edge region of the rear side 9 is not covered by the reflector layer 10. The reflector layer 10 may have been applied by means of a planar fabrication method of semiconductor production, e.g. by sputtering.

The reflector layer 10 may be a dielectric or a metallic reflector layer 10. Particularly for the case where the reflector layer 10 is a dielectric reflector layer 10, the second insulation layer 8 can also be dispensed with. For the case where the reflector layer 10 is a metallic reflector layer 10, it can e.g. consist of silver or include silver, as a result of which particularly high reflectances can be achieved.

At the rear side 9, there is arranged in the edge region of the second insulation layer 8 at least one electrically conductive conductor track, of which exactly one conductor track 11 is shown here. The conductor track 11 likewise bears on the rear side 9 of the second insulation layer 8 and is e.g. fixedly connected thereto. The conductor track 11 extends laterally at a distance from the reflector layer 10 and is electrically insulated therefrom. The conductor track 11, too, may have been applied by means of a planar fabrication method of semiconductor production, e.g. by sputtering. It may be provided that if the reflector layer 10 consists of metal, the conductor track 11 consists of the same metal, e.g. of silver.

The reflector layer 10 and the conductor track(s) 11 are embedded or buried in a first insulation layer 12. The first insulation layer 12, outside the reflector layer 10 and the conductor track(s) 11, is adjacent to the second insulation layer 8, e.g. over the whole area there, and is e.g. fixedly connected thereto. The first insulation layer 12, too, may have been applied by means of a planar fabrication method of semiconductor production, e.g. by sputtering.

The first insulation layer 12 is thus arranged below the converter layer 3. It includes or essentially consists of an electrically insulating material, e.g. ceramic, and thus electrically insulates the reflector layer 10 and the conductor track(s) 11 from one another in a particularly effective manner. The reflector layer 10 and the conductor track(s) 11 are thus arranged, e.g. with a flush surface, at a front side 13 of the first insulation layer 12 facing the converter layer 3.

At two points spaced apart from one another, electrically conductive contacts or vias 14 extend perpendicularly through the first insulation layer 12 and contact the conductor track 11 and lead to a rear side 15 of the first insulation layer 12 in an exposed manner. The vias 14 thus electrically connect the conductor track 11 to the rear side 15.

The vias 14 may, but need not, include or essentially consist of the same material, e.g. metal, as the conductor track 11. In this regard, they may also include or essentially consist of a different material, particularly suitable e.g. for through contacts, e.g. metal, e.g. of copper or a silver/copper alloy. The vias 14, too, may have been applied by means of a planar fabrication method of semiconductor production, e.g. by sputtering.

An electrically conductive transition layer 16 is adjacent to the rear side 15 of the first insulation layer 12. The transition layer 16 may include or essentially consist of electrically conductive ceramic.

The transition layer 16 includes a plurality of partial regions 16*a*, 16*b*, 16*c* separated from one another, which are separated or spaced apart from one another by incisions 17, such that the partial regions 16*a*, 16*b*, 16*c* are electrically insulated from one another. The transition layer 16, too, may have been applied by means of a planar fabrication method of semiconductor production, e.g. by sputtering.

Two partial regions 16*a* and 16*b* contact a respective via 14 at the top side and are thus electrically connected to the associated one via 14. These partial regions 16*a*, 16*b* serve as mutually spaced apart contact elements ("solder connection volumes") for securing and electrically connecting the wavelength converter 2 or the conductor track 11 thereof.

A further partial region 16*c* serves as a heat transfer volume. The partial region 16*c* is thus likewise arranged at the rear side 15 of the first insulation layer 12.

The headlight/spotlight 1 is constructed e.g. such that it includes a converter assembly 18. The converter assembly 18 includes at least one wavelength converter 2 and an e.g. ceramic carrier substrate 19. The wavelength converter 2 is secured to the carrier substrate 19 by its transition layer 16, specifically by way of an electrically conductive soldering layer 20 with respectively associated electrically conductive contact areas 21 of the carrier substrate 19. The contact areas 21 can be e.g. contact pads or the like, which can readily be soldered.

The soldering layer 20 fixedly connects the partial regions 16*a*, 16*b*, 16*c* of the transition layer 16 to the associated contact areas 21, but leaves the incisions 17 free, such that the partial regions 16*a*, 16*b*, 16*c* are connected to the carrier substrate 19 separately from one another. Soldering the wavelength converter 2 onto the carrier substrate 19 or the contact areas 21 thereof can be carried out by means of an SMT process.

The wavelength converter 2 here is secured to a substrate front side 22 of the carrier substrate 19. The contact areas 21 are connected to respective electrically conductive through contacts 23. The carrier substrate 19 has, at its substrate rear side 24, a wiring 25 connected to the through contacts 23.

The partial region 16*c* serving as a heat transfer volume is also soldered to the carrier substrate 19 by way of an associated contact area 21, such that an effectively thermally conductive heat transfer zone is provided between the partial region 19 and the carrier substrate 19. All contact areas are electrically insulated from one another on the carrier substrate 19.

The converter assembly 18 and the primary light source 4 can also be regarded or grouped as a lighting device 4, 18. The lighting device 4, 18 can be configured as a module.

The headlight/spotlight 1, e.g. the lighting device 4, 18 thereof, can additionally include a detector circuit 26, which is electrically connected to the partial regions 16*a*, 16*b* and thus to the conductor track 11 by way of the wiring 25 and which is configured to monitor the at least one conductor track 11 for damage. The detector circuit 26 is electrically connected to the conductor track 11 by way of the vias 14, the partial regions 16*a* and respectively 16*b*, the soldering layer 20, the contact areas 21, the through contacts 23 and the wiring 25.

The headlight/spotlight 1 can furthermore include a control unit 27 for driving or operating the lighting device 4, 18. The control unit 27 is coupled to the detector circuit 26, such that the headlight/spotlight 1 or the lighting device 4, 18 is configured to initiate at least one action in response to damage to the conductor track 11 being identified, e.g. to dim or even entirely switch off the primary light source 4. The lighting device 4, 18 can also correspond to the headlight/spotlight 1.

Figure 2:
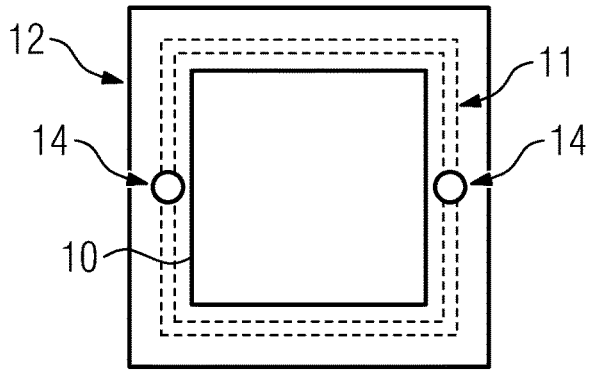
FIG. 2 shows, in plan view, a first insulation layer of the wavelength converter in accordance with the first embodiment with elements arranged on a front side of the first insulation layer.

FIG. 2 shows, in plan view, the first insulation layer 12 of the wavelength converter 2 with, arranged thereon, the elements: reflector layer 10, conductor track 11 and vias 14.

The reflector layer 10 is configured as a layer that is rectangular in plan view. The conductor track 11 has a course that is ring-shaped in a closed manner extending circumferentially around the reflector layer 10, here for example a rectangular basic shape. The vias 14 are introduced at opposite points of the conductor track 11.

Figure 3:
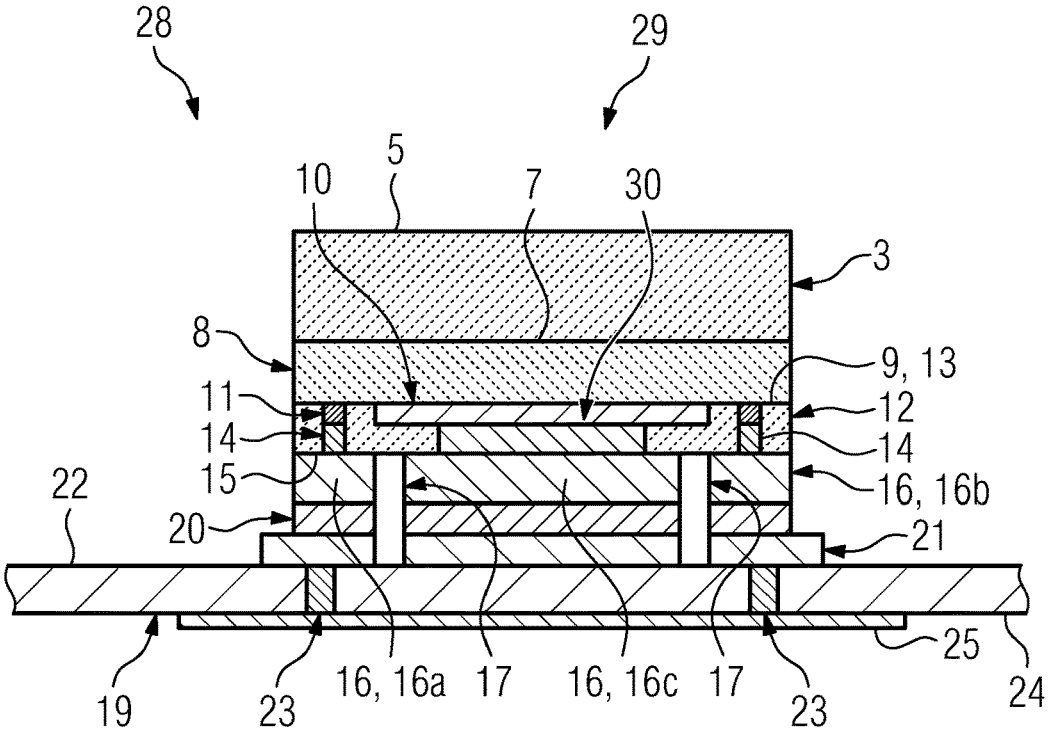
FIG. 3 shows, as a sectional illustration in side view, a wavelength converter in accordance with a second embodiment.

FIG. 3 shows, as a sectional illustration in side view, a converter assembly 28 including a wavelength converter 29 in accordance with a second embodiment, which is fitted on the carrier substrate 19. The wavelength converter 29 is constructed in a similar manner to the wavelength converter 2 and can also be installed instead of the wavelength converter 2 in the headlight/spotlight 1.

In contrast to the wavelength converter 2, the wavelength converter 29 includes a heat conductive volume 30 extending from the reflector layer 10 to the partial region 16*c* serving as a heat transfer volume. The heat conductive volume 30 fills a corresponding cutout in the first insulation layer 12. The heat conductive volume 30 can consist e.g. of metal, e.g. of the same metal as a metallic reflector layer 10, if present.

The cutout for the heat conductive volume 30, cutouts for the vias 14 and/or the incisions 17 etc. may have been applied by means of a planar fabrication method of semiconductor production, e.g. by etching.

Although the invention has been more specifically illustrated and described in detail by means of the exemplary embodiments shown, nevertheless the invention is not restricted thereto and other variations can be derived therefrom by the person skilled in the art, without departing from the scope of protection of the invention.

Generally, "a(n)", "one", etc. can be understood to mean a singular or a plural, e.g. in the sense of "at least one" or "one or a plurality", etc., as long as this is not explicitly excluded, e.g. by the expression "exactly one", etc.

Moreover, a numerical indication can encompass exactly the indicated number and also a customary tolerance range, as long as this is not explicitly excluded.

LIST OF REFERENCE SIGNS headlight/spotlight 1
wavelength converter 2
converter layer 3
primary light
secondary light
primary light source 4
front side of the converter layer 5
coupling-out optical unit 6
rear side of the converter layer 7
second insulation layer 8
rear side of the second insulation layer 9
reflector layer 10
conductor track 11
first insulation layer 12
front side of the first insulation layer 13
via 14
rear side of the first insulation layer 15
transition layer 16
partial region of the transition layer 16*a*
partial region of the transition layer 16*b*
partial region of the transition layer 16*c*
incision 17
converter assembly 18
carrier substrate 19
soldering layer 20
contact area 21
substrate front side 22
through contact 23
substrate rear side 24
wiring 25
detector circuit 26
control unit 27
converter assembly 28
heat conductive volume 30
primary light P
secondary light S While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A wavelength converter, comprising:

a converter layer for at least partly converting primary light of a first spectral composition into secondary light of a second spectral composition;

an electrically insulating first insulation layer arranged below the converter layer, a mirror being arranged at the front side of said insulation layer facing the converter layer;

at least one conductor track which is arranged at the first insulation layer and which extends laterally at a distance from the mirror;

mutually spaced apart contacts extending through the first insulation layer, of which contacts in each case at least two contacts electrically connect a conductor track to a rear side of the first insulation layer; and mutually spaced apart electrically conductive solder connection volumes arranged below the first insulation layer, said solder connection volumes being electrically connected in each case to one of the contacts.

2. The wavelength converter of claim 1, wherein the at least one conductor track is embedded or buried in the first insulation layer.

3. The wavelength converter of claim 1, wherein a second insulation layer, which second insulation layer is optically transmissive to the primary light and the secondary light, is present between the converter layer and the first insulation layer.

4. The wavelength converter of claim 1, wherein at least one conductor track is a conductor track which surrounds the mirror in a ring-shaped fashion.

5. The wavelength converter of claim 1, wherein an electrically conductive transition layer is arranged at the rear side of the first insulation layer, said transition layer comprising a plurality of partial regions separated from one another, and the solder connection volumes correspond to partial regions.

6. The wavelength converter of claim 1, wherein the solder connection volumes consist of electrically conductive ceramic.

7. The wavelength converter of claim 1, wherein at least one heat transfer volume is arranged at the rear side of the first insulation layer.

8. The wavelength converter of claim 5, wherein at least one heat transfer volume is arranged at the rear side of the first insulation layer;

wherein the at least one heat transfer volume corresponds to a partial region of the transition layer.

9. The wavelength converter of claim 7, wherein the first insulation layer has a cutout extending from the mirror to the heat transfer volume, said cutout being filled with a heat conductive volume.

10. The wavelength converter of claim 1, wherein the solder connection volumes consist of electrically conductive ceramic.

11. The wavelength converter of claim 1, wherein the mirror is a metallic mirror and the at least one conductor track consists of the same material as the mirror.

12. The wavelength converter of claim 1, wherein the wavelength converter is an SMT component.

13. A converter assembly, comprising:

at least one wavelength converter, comprising:

a converter layer for at least partly converting primary light of a first spectral composition into secondary light of a second spectral composition;

an electrically insulating first insulation layer arranged below the converter layer, a mirror being arranged at the front side of said insulation layer facing the converter layer;

at least one conductor track which is arranged at the first insulation layer and which extends laterally at a distance from the mirror;

mutually spaced apart contacts extending through the first insulation layer, of which contacts in each case at least two contacts electrically connect a conductor track to a rear side of the first insulation layer; and mutually spaced apart electrically conductive solder connection volumes arranged below the first insulation layer, said solder connection volumes being electrically connected in each case to one of the contacts;

wherein the at least one wavelength converter is secured to at least one carrier substrate of the converter assembly and is electrically connected to the carrier substrate by way of the solder connection volumes;

wherein at least one wavelength converter is secured and electrically connected to an associated carrier substrate by way of a soldering layer;

wherein the at least one wavelength converter is secured to a substrate front side of the carrier substrate;

wherein the carrier substrate has a respective through contact at connection points to the solder connection volumes; and wherein the carrier substrate has, at a substrate rear side, a wiring connected to the through contacts.

14. A lighting device, comprising:

at least one converter assembly, comprising:

at least one wavelength converter, comprising:

a converter layer for at least partly converting primary light of a first spectral composition into secondary light of a second spectral composition;

an electrically insulating first insulation layer arranged below the converter layer, a mirror being arranged at the front side of said insulation layer facing the converter layer;

at least one conductor track which is arranged at the first insulation layer and which extends laterally at a distance from the mirror;

mutually spaced apart contacts extending through the first insulation layer, of which contacts in each case at least two contacts electrically connect a conductor track to a rear side of the first insulation layer; and mutually spaced apart electrically conductive solder connection volumes arranged below the first insulation layer, said solder connection volumes being electrically connected in each case to one of the contacts;

wherein the at least one wavelength converter is secured to at least one carrier substrate of the converter assembly and is electrically connected to the carrier substrate by way of the solder connection volumes;

wherein at least one wavelength converter is secured and electrically connected to an associated carrier substrate by way of a soldering layer;

wherein the at least one wavelength converter is secured to a substrate front side of the carrier substrate;

wherein the carrier substrate has a respective through contact at connection points to the solder connection volumes; and wherein the carrier substrate has, at a substrate rear side, a wiring connected to the through contacts;

at least one primary light source configured to irradiate the converter layer with the primary light; and a detector circuit, which is electrically connected to the solder connection volumes and which is configured to monitor the at least one conductor track for damage;

wherein the lighting device is configured to initiate at least one action upon damage to at least one conductor track being identified.

15. The lighting device of claim 14, wherein the at least one primary light source comprises a laser light source configured to irradiate the converter layer with the primary light.

* * * * *